US005814793A

United States Patent [19]

Yu

[11] Patent Number: 5,814,793

[45] Date of Patent: Sep. 29, 1998

[54] AIR FLOW SYSTEM FOR MICROWAVE OVENS

[75] Inventor: Kyu Moon Yu, Gyeongnam, Rep. of Korea

[73] Assignee: LG Electronics Inc., Seoul, Rep. of Korea

[21] Appl. No.: 643,135

[22] Filed: May 2, 1996

[30] Foreign Application Priority Data

May 16, 1995 [KR] Rep. of Korea ..... 1995/12082

[51] Int. Cl.[6] ..... H05B 6/64

[52] U.S. Cl. ..... 219/757; 126/21 A

[58] Field of Search ..... 219/757, 681; 126/21 A

[56] References Cited

U.S. PATENT DOCUMENTS

| | | | |
|---|---|---|---|
| 4,546,225 | 10/1985 | McCammon | 219/757 |
| 4,623,771 | 11/1986 | Sakino | 219/757 |
| 4,705,928 | 11/1987 | Nakanishi | 219/757 |
| 4,812,617 | 3/1989 | Takeuji et al. | 219/757 |
| 5,393,961 | 2/1995 | Umekage et al. | 219/757 |

FOREIGN PATENT DOCUMENTS

| | | | |
|---|---|---|---|
| 54-14039 | 2/1979 | Japan | 219/757 |
| 63-201427 | 8/1988 | Japan | 219/757 |
| 2 239 379 | 6/1991 | United Kingdom | 219/757 |

*Primary Examiner*—Philip H. Leung
*Attorney, Agent, or Firm*—Calfee, Halter & Griswold LLP

[57] ABSTRACT

An air flow system for cooling heat generating elements, such as a magnetron and high voltage transformer, of microwave ovens is disclosed. Air inlet holes are formed on the casing's bottom at a portion in the front of the fan. Air outlet holes are formed on the casing's rear wall. A fan is set in an air guide wall standing on the casing's bottom at a portion between the inlet holes and the heat generating elements. In the system, the outside air is introduced into the casing through the inlet holes by the blowing force of the fan and cools the heat generating elements prior to exhausting to the atmosphere through the outlet holes. The air guide wall eliminates reverse flow of the air in the casing. The cavity has air guide holes on one side wall thereof and cavity air exhaust holes on the other wall thereof, so the air is directly introduced into the cavity.

4 Claims, 2 Drawing Sheets

AIR FLOW SYSTEM FOR MICROWAVE OVENS

BACKGROUND OF THE INVENTION

1. Field of the Invention

The present invention relates in general to air flow system for cooling heat generating elements, such as a magnetron and high voltage transformer, of microwave ovens and, more particularly, to a structural improvement in such systems to more effectively cool the heat generating elements and deodorize the cooking cavity in the ovens.

2. Description of the Prior Art

Microwave ovens are provided with several electrical elements, such as the high frequency wave generating magnetron and high voltage transformer that supplies high voltage to the magnetron. Both the magnetron and the high voltage transformer are mounted aside the cooking cavity in the oven casing and generate heat, thus being referred to heat generating elements occasionally in the following description. In the above microwave ovens, the above heat generating elements are cooled by an air flow system or cooling system. The cooling system comprises a cooling fan which is placed aside both the magnetron and the high voltage transformer. The above cooling fan forcibly introduces outside air into the oven casing thus causing the air to circulate around the heat generating elements while cooling the elements.

The construction of a microwave oven with a typical cooling system is shown in FIG. 1. As shown in the drawing, a magnetron 2 is mounted to the exterior side wall of a cooking cavity 1 inside the oven casing. A high voltage transformer 3 is mounted to the inside bottom of the casing. The cooling system for the oven includes a cooling fan 4 which is provided behind both the magnetron 2 and the transformer 3. The above fan 4 is mounted to a suction air guide panel 5. The panel 5 is mounted to the interior surface of the casing's rear wall. In the operation of the above cooling system, the blowing force of the fan 4 forcibly introduces outside air into the casing through a plurality of air inlet holes 1*a* formed on the rear wall of the casing. The air circulates around both the magnetron 2 and the transformer 3 to cool them.

The air which has passed the magnetron 2 in turn is guided to the air duct 6 and introduced into the cavity 1. In this case, the air passes through a plurality of air guide holes 1*b* formed on one side wall of the cavity 1. In the above cavity 1, the air is laden with odor diffused from the food inside the cavity 1 prior to exhausting to the atmosphere through a plurality of cavity air exhaust holes 1*c*. The above exhaust holes 1*c* are formed on the other side wall of the cavity 1. On the other hand, the air which has passed the high voltage transformer 3 in turn exhausts from the casing downward through a plurality of bottom air outlet holes 1*d* and in turn flows forward. The above air outlet holes 1*d* are formed on the bottom of the casing at a portion before the transformer 3.

FIG. 2 shows the construction of a microwave oven with another type cooling system according to the prior art. In the above oven, the cooling system includes an air guide bracket 7 for guiding the air inside the oven casing. The bracket 7 is mounted to the casing bottom to cover the high voltage transformer 3 that is also mounted to the casing bottom. The cooling system also includes a fan 4 and air duct 8 which are provided above the above bracket 7. The above air duct 8 guides the air, blown by the fan 4, to the magnetron 2. In the operation of the above cooling system, the outside air is forcibly introduced into the oven casing by the blowing force of the fan 4. In this case, the air passes through a plurality of air suction slits formed on the casing bottom. The air cools the high voltage transformer 3 while flowing under the guide of the bracket 7. The air in turn is guided to the magnetron 2 by the air duct 8, thus cooling the magnetron 2. Thereafter, the air exhausts to the atmosphere through a plurality of air exhaust slits formed on the rear wall of the casing.

However, the cooling system shown in FIG. 1 has the following problems. In the above cooling system, the air primarily passes by the magnetron 2 and in turn is introduced into the cavity 1 under the guide of the air duct 6, so the air current speed is reduced by the air duct 6. Due to the above reduced air current speed, the air fails to effectively eliminate odor diffused from the food inside the cavity 1. Furthermore, as the air that has passed by the magnetron 2 is introduced into the cavity 1, the air may be contaminated by the dirty magnetron 2 and thereby give a bad effect to the food inside the cavity 1. As the air duct 6 has a bent configuration, disturbing the smooth air current, the air may reversely flow inside the duct 6 thus reducing the cooling effect for the magnetron 2.

In the above cooling system, the air whose temperature has been raised while the air passes by the high voltage transformer 3 is brought into contact with the circuit board of the control unit, thus heating the circuit board and causing an operational error of the control unit. Therefore, the cooling system may reduce the operational reliability of the microwave oven. Another problem of the above cooling system is resided in that the lead wire (not shown) extending to the fan 4 may be fused and shorted as the lead wire extends above the magnetron 2.

The cooling system shown in FIG. 2 must be provided with both the bracket 7 and the air duct 8 for smooth air circulation. However, the bracket 7 and air duct complicate the construction of the above cooling system and increases the cost and thereby reducing the productivity of the coven.

SUMMARY OF THE INVENTION

It is, therefore, an object of the present invention to provide an air flow system for microwave ovens in which the above problems can be overcome and which lets the outside air be directly introduced into the cavity without passing by the magnetron, thus preventing the air from being contaminated by the dirty magnetron and from giving a bad effect to the food inside the cavity.

It is another object of the present invention to provide an air flow system for microwave ovens which lets the air, having cooled both the magnetron and the high voltage transformer, directly exhaust to the atmosphere thereby improving the cooling effect.

It is a further object of the present invention to provide an air flow system for microwave ovens which lets the air be introduced into the oven casing rearward and in turn exhaust to the atmosphere through the perforated rear wall, thus preventing the hot air from exhausting toward the users and thereby being convenient to the users.

In order to accomplish the above objects, the present invention provides an air flow system for microwave ovens comprising a fan placed in the front of both the magnetron and the high voltage transformer, a plurality of air inlet holes formed on the bottom of the oven casing at a portion in the front of the fan, and a plurality of air outlet holes formed on the rear wall of the casing. In the above air flow system, the outside air is forcibly introduced into the casing through the air inlet holes, formed on the front portion of the casing's bottom, due to the blowing force of the fan and cools the magnetron and high voltage transformer prior to exhausting to the atmosphere through the air outlet holes of the casing's rear wall.

In the above air flow system, the fan is set in an air guide wall standing on the casing's bottom at a portion between the air inlet holes and the high voltage transformer. The above air guide wall has a width equal to that between opposite side walls of the cavity and casing and has a height equal to that of the cavity, thereby eliminating reverse flow of the air that has passed the fan.

In order to directly introduce the air into the cavity, a plurality of air guide holes are formed on one side wall of the cavity at a portion between the fan and magnetron. In a preferred embodiment, a plurality of cavity air exhaust holes are formed on the other wall of the cavity. The cavity air exhaust holes may be formed on the top wall of the cavity.

In the above air flow system, the blowing force of the fan sucks the outside air into the casing through the air inlet holes of the casing's bottom. A part of the air inside the casing cools both the magnetron and the high voltage transformer prior to directly exhausting to the atmosphere through the air outlet holes of the casing's rear wall. Another part of the air inside the casing is introduced into the cavity through the air guide holes and in turn exhausts to the atmosphere through the cavity air exhaust holes.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
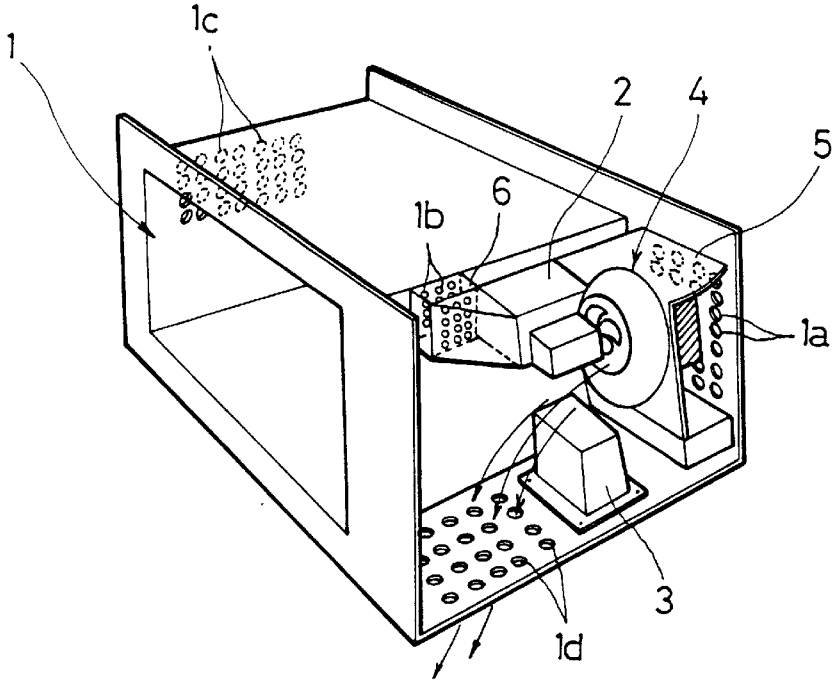
FIG. 1 is a perspective view of a microwave oven with a typical cooling system, showing the construction of the cooling system.
Figure 2:
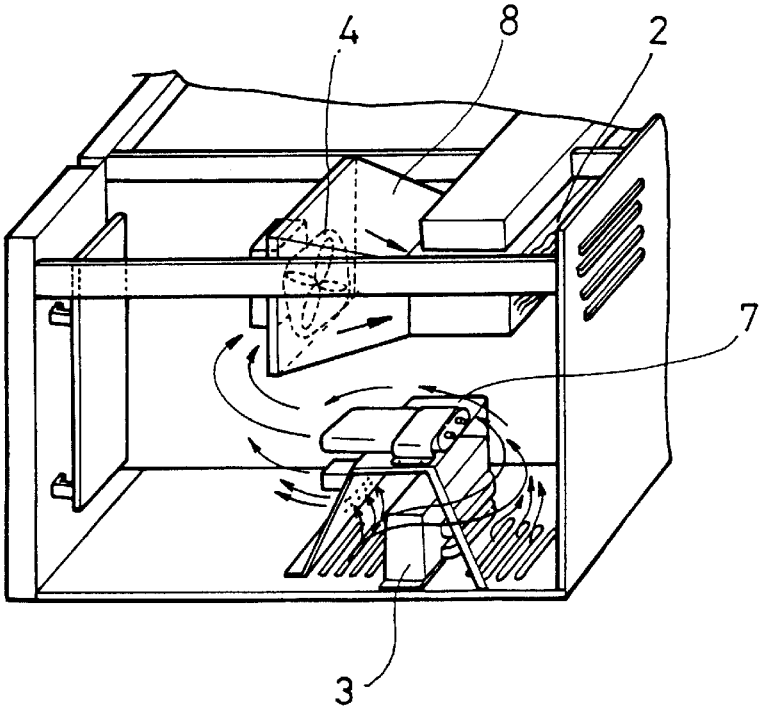
FIG. 2 is a view corresponding to FIG. 1, but showing the construction of another type cooling system according to the prior art.
Figure 3:
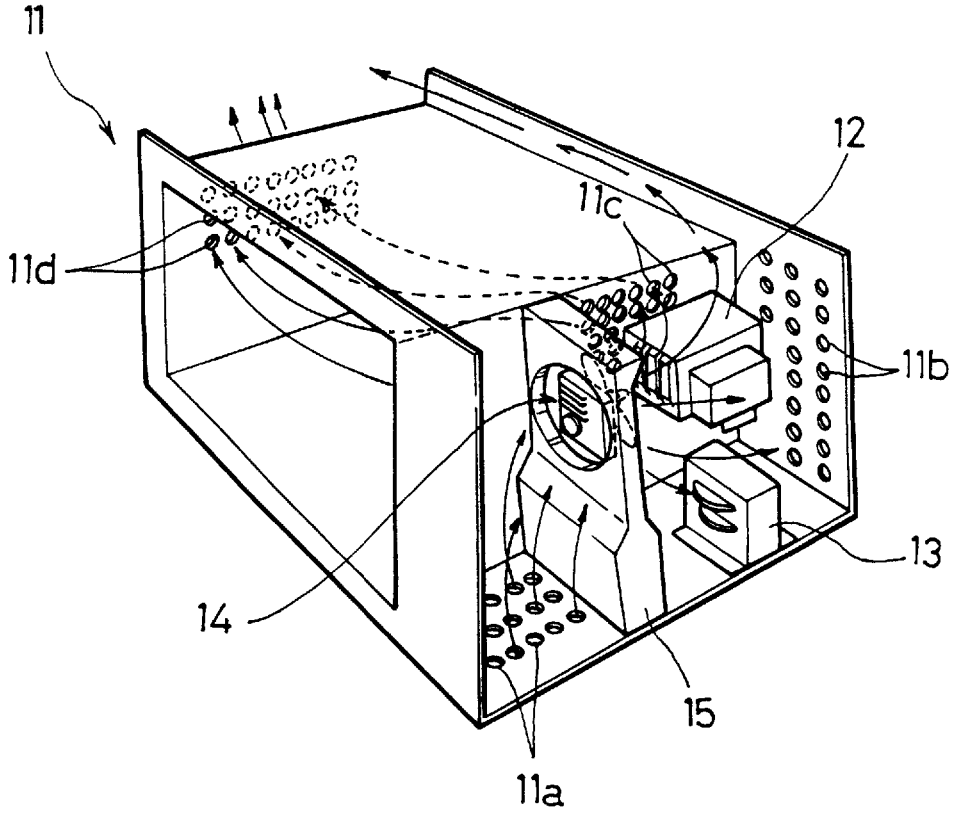
FIG. 3 is a perspective view of a microwave oven with an air flow system according to the preferred embodiment of the present invention, showing the construction of the system.

FIG. 3 shows the construction a microwave oven with an air flow system according to the preferred embodiment of the present invention. In the above oven, the magnetron 12 and high voltage transformer 13 are mounted inside a space formed between the cooking cavity 11 and the oven casing. A fan 14 is provided in the above space in the front of both the magnetron 12 and the transformer 13. The above fan 14 is set in an air guide wall 15 that stands on the casing's bottom. The above air guide wall 15 extends between opposite side walls of the cavity 11 and casing and has a height equal to that of the cavity 11. That is, the air guide wall 15 stands in the front of both the magnetron 12 and the transformer 13.

A plurality of air inlet holes 11*a* are formed on the casing's bottom at a portion in the front of the above guide wall 15, while a plurality of air outlet holes 11*b* are formed on the rear wall of the casing. One side wall of the cavity 11 is perforated at a portion between the magnetron 12 and the fan 14, thus forming a plurality of air guide holes 11*c* for directly guiding the air into the cavity 11. In order to exhaust the cavity air to the atmosphere, the other side wall of the cavity 11 is perforated to form a plurality of cavity air exhaust holes 11*d*.

In the operation of the above air flow system, the fan 14 starts to generate the blowing force, thus forcibly sucking outside air into the space through the air inlet holes 11*a* that are formed on the front portion of the casing's bottom. The air passes through the fan 14 to be partially guided to both the magnetron 12 and the transformer 13, thereby cooling the magnetron and transformer prior to exhausting to the atmosphere through the air outlet holes 11*b* of the casing's rear wall.

Another part of the air sucked into the space is introduced into the cavity 11 through the air guide holes 11*c* of the cavity 11. The air inside the cavity 11 exhausts to the atmosphere along with odor, diffused from the food inside the cavity 11, through the air exhaust holes 11*d*. The air flow system thus effectively eliminates the odor diffused from the food in the cavity 11.

The air inside the casing also partially flows over the cavity 11. When the above system is used with a multi-functional microwave oven having a heater, the air flowing over the cavity 11 effectively dissipates heat generated from the heater.

In the above system, the amount of air introduced into the cavity 11 and the amount of air guided to the magnetron 12 and transformer 13 are controlled by adjusting the blowing direction of the fan 14. In addition, the air that has passed the fan 14 does not return to the front of the air guide wall 15 as the guide wall 15 acts as a shielding wall.

As described above, the air introduced into the casing by the blowing force of the fan 14 is partially guided to both the magnetron 12 and the transformer 13, thus cooling them prior to directly exhausting to the atmosphere through the air outlet holes 11*b*. The air flow system of this invention thus more effectively cool the heat generating elements of the microwave oven. Another part of the air inside the casing is directly introduced into the cavity without passing by the dirty magnetron 12 differently from the prior art system. The air introduced into the cavity 11 also retains the high current speed, so the air effectively eliminates odor diffused from the food inside the cavity 11 without giving any bad effect to the food.

In addition, the system of this invention is free from an air duct or bracket which is necessarily provided in a typical system, thus reducing the number of the elements of the system and thereby reducing the cost. The above system does not exhaust the hot air forward but exhausts backward, thus being convenient to the users.

In the above system, the air inside the casing also partially flows over the cavity. When the above system is used with a multi-functional microwave oven having a heater, the air flowing over the cavity effectively dissipates heat generated from the heater.

Furthermore, the fresh air instead of the hot air flows around the circuit board of a control unit differently from the typical system. In this regard, the system of this invention protects the circuit board from thermal shock thereby improving the operational reliability of the oven.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air flow system for microwave ovens comprising:

an oven casing surrounding a cooking cavity having a plurality of air guide holes on one side wall thereof and a plurality of air exhaust holes on another side wall thereof;

said oven casing surrounding said cooking cavity and a space between a sidewall of said cooking cavity and one side wall of said casing, said casing having a plurality of air guide inlet and outlet holes on a bottom and rear wall thereof, respectively, at portions outside said cooking cavity;

a magnetron mounted in said space inside said casing adjacent said air guide holes;

a high voltage transformer mounted in said space at a position adjacent said air guide holes formed on the bottom of said casing;

an air guide wall mounted in said space at a position separating said air guide inlet holes from both the magnetron and the transformer; and a fan mounted in said air guide wall and adapted to draw outside air into said space through said air inlet holes and to direct a portion of the outside air toward both the magnetron and the transformer and another portion of the outside air into the cooking cavity.

2. The air flow system according to claim 1, wherein said air guide wall has a width equal to that between opposite side walls of said cooking cavity and casing and has a height equal to that of said cooking cavity, thereby eliminating reverse flow of air that has passed said fan.

3. The air flow system according to claim 1, wherein an amount of air introduced into said cooking cavity and an amount of air guided to the magnetron and transformer are controlled by adjusting the blowing direction of said fan.

4. An air flow cooling system for microwave ovens comprising:

a cooking cavity surrounded by an oven casing, the cooking cavity having top, bottom and side walls and air flow guide holes in a side wall, a second cavity within the oven casing adjacent the cooking cavity, the second cavity having top, bottom and side walls and air flow guide holes in the bottom wall and in one side wall, a magnetron and transformer mounted in the second cavity, and an air guide wall dividing the second cavity with the air flow guide holes in the bottom wall of the second cavity on one side of the air guide wall, and the magnetron and transformer on an opposite side of the air guide wall, and a fan mounted in the air guide wall and operative to move air through the air flow guide holes in the bottom wall of the second cavity, through the air guide wall and (a) past the magnetron and transformer and out of the second cavity through the air flow guide holes in the one side wall of the second cavity, and (b) through the air flow guide holes in a side wall of the cooking cavity.

* * * * *